US005557950A

United States Patent [19]

Richards et al.

[11] Patent Number: 5,557,950

[45] Date of Patent: Sep. 24, 1996

[54] WARP KNITTED PLUSH FABRIC RESISTANT TO PILE PULL-THROUGH

[75] Inventors: David T. Richards, Greensboro; Phillip D. McCartney, Oak Ridge; Billy J. Casper, Greensboro, all of N.C.

[73] Assignee: Guilford Mills, Inc., Greensboro, N.C.

[21] Appl. No.: 460,134

[22] Filed: Jun. 2, 1995

[51] Int. Cl.[6] ..... D04B 21/04; D04B 11/08; D04B 23/08

[52] U.S. Cl. ..... 66/194; 66/202

[58] Field of Search ..... 66/190, 194, 202; 139/420 A, 426 R

[56] References Cited

U.S. PATENT DOCUMENTS

| | | | |
|---|---|---|---|
| 4,482,594 | 11/1984 | Stousland | 428/92 |
| 4,567,075 | 1/1986 | Krawczyk | 428/91 |
| 4,712,281 | 12/1987 | Scheller | 28/162 |
| 4,712,366 | 12/1987 | Tsujimoto et al. | 57/245 |
| 4,881,383 | 11/1989 | Spillane et al. | 66/194 |
| 5,065,600 | 11/1991 | Byles | 66/193 |
| 5,214,942 | 6/1993 | Peake, III et al. | 66/194 |
| 5,267,453 | 12/1993 | Peake, III et al. | 66/194 |

OTHER PUBLICATIONS

A. Reisfeld, "Warp Knit Fabrics and Products; Part 17", Knitted Times, Feb. 22, 1971 vol.40, No. 8, pp. 38–48.

K. D. Darlington, "Analysis of Trico Velour Fabrics", Knitting Times, Feb. 16, 1976, vol. 45, No. 7, pp. 34–37.

Guilford Mills, Inc. Construction Sheet, fabric entitled "ELEGANCE", Aug. 11, 1994.

*Primary Examiner*—John J. Calvert

*Attorney, Agent, or Firm*—Shefte, Pinckney & Sawyer

[57] ABSTRACT

A velvet fabric is produced by warp knitting on a three-bar warp knitting machine by knitting ground yarns on the machine's middle bar to provide structural and dimensional integrity to the fabric and pile yarns on the machine's top bar in extended underlaps which are shearable, nappable, brushable, or otherwise raisable to produce an upstanding raised pile. In order to resist any tendency of the pile yarn to be pulled from the fabric, the present invention contemplates that the pile yarns should be microdenier multifilament synthetic yarns while the ground yarns should also be multifilament synthetic yarns of a relatively low denier per filament not exceeding approximately 1.5 denier per filament and of a total collective denier approaching but not exceeding that of the pile yarns, preferably in excess of about 75 percent of the total denier of the pile yarns.

12 Claims, 1 Drawing Sheet

WARP KNITTED PLUSH FABRIC RESISTANT TO PILE PULL-THROUGH

BACKGROUND OF THE INVENTION

The present invention relates generally to knitted fabrics and methods of producing such fabrics and, more particularly, to a warp knitted fabric whose technical back has a plush surface formed by brushed, napped, sheared, or otherwise raised pile yarns.

It is well-known to produce warp knitted textile fabric with a plush raised surface on its technical back by warp knitting one set of warp yarns in a stitch pattern producing extending underlaps of the yarn at the technical back of the fabric which can be napped or otherwise brushed to separate and raise individual fibers in the underlap extents of the yarns. It is also well-known to shear upstanding loops on various forms of pile-type textile fabrics, sometimes followed by a brushing process to produce a velvet or velour-type surface effect. Attempts have been made to shear the extended underlaps on warp knitted fabrics of the aforedescribed type in order to produce a velvet-like surface effect, but problems have been encountered with the tendency of the yarn segments remaining anchored in stitches of the knitted fabric to be susceptible to being pulled easily from the fabric ground structure.

SUMMARY OF THE INVENTION

In contrast to the prior art, it is an object of the present invention to provide a knitted plush fabric whose construction has the unique ability to resist any tendency of the pile to be pulled from the fabric structure.

Briefly summarized, the foregoing objective is accomplished in the present invention by utilizing in the structure of the fabric a unique combination of ground and pile yarns whose respective physical characteristics cooperate to resist pile pull-through even in stretchable elastic versions of the fabric. More particularly, the textile fabric of the present invention is basically of a knitted construction, preferably warp knitted, comprising ground and pile yarns interknitted with one another in stitches arranged in longitudinally extending fabric wales and transversely extending fabric courses. Accordingly to the present invention, the pile yarns are microdenier multifilament synthetic yarns, i.e., wherein each filament is less than about 1 denier and the ground yarns likewise are synthetic multifilament yarns each filament of which is no greater than about 1.5 denier with each ground yarn being a total denier at least greater than about one-half that of the pile yarns and preferably approaching that of the pile yarns (e.g., greater than about 75% of the total denier of the pile yarns) without exceeding the total denier of the pile yarns. By way of example, the pile yarns may preferably comprise a total of about 50 filaments of a total denier collectively of about 45, while the ground yarns may comprise a total of about 30 filaments of a total denier collectively of about 40.

Preferably, the pile yarns are warp knitted in coursewise spaced stitches with extended underlaps therebetween at the technical back of the fabric which underlaps are severed by shearing, napping, brushing, or otherwise raising to form an outwardly extended plush surface, the ground yarns being warp knitted in a dimensionally stable stitch pattern predominantly at the technical face of the fabric to anchor the pile yarn in the ground structure of the fabric. In the preferred embodiment, for example, the pile yarns may be warp knitted in a 6-7,1-0 stitch pattern, while the ground yarns are warp knitted in a 1-2,1-0 stitch pattern.

It is also preferred that the fabric include elastic yarns interknitted with the ground and pile yarns to provide the fabric with a degree of stretchability, the elastic yarns preferably being of a total denier substantially less than the ground yarns.

DESCRIPTION OF THE PREFERRED EMBODIMENTS

Figure 1:
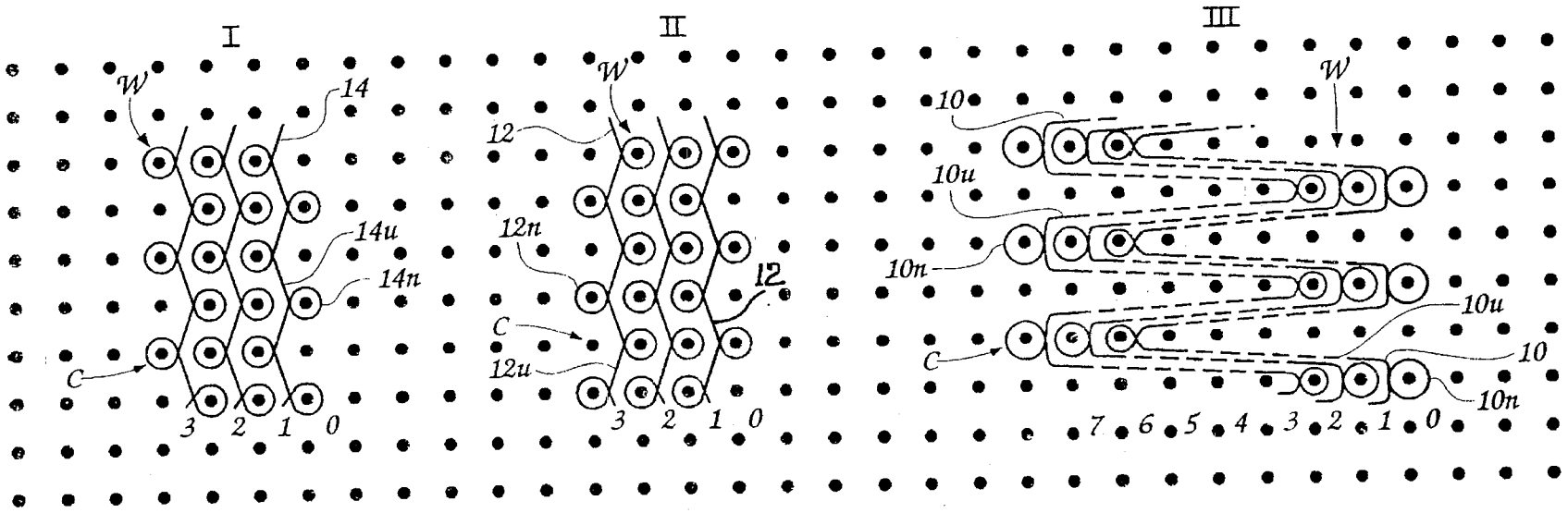
FIG. 1 is a diagram showing individually the stitch patterns for the pile, ground, and elastic yarns carried out by a warp knitting machine in knitting one preferred embodiment of the present fabric according to the method of the present invention.

As explained more fully herein, the fabric of the present invention is formed on a warp knitting machine which may be of any conventional type of an at least three-bar construction having three or more yarn guide bars and a needle bar, e.g., a conventional tricot warp knitting machine. The construction and operation of such machines are well-known in the knitting art and need not herein be specifically described and illustrated. In the following description, the yarn guide bars of the knitting machine are identified as "top", "middle", and "bottom" guide bars for reference purposes only and not by way of limitation. As those persons skilled in the art will understand, such terms equally identify knitting machines whose guide bars may be referred to as "front", "middle", and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different sets of warp yarns included in the fabric, all as is conventional terminology in the art.

As in conventional, the needle bar of the warp knitting machine carries a series of aligned knitting needles, while each guide bar of the machine carries a series of guide eyes, the needle and guide bars of the machine preferably having the same gauge, i.e., the same number of needles and guide eyes per inch. According to the embodiment of the present fabric illustrated in FIG. 1, the top (or front) yarn guide bar III of the machine is threaded on every guide eye with a first set of pile yarns 10 delivered from a warp beam (not shown), the yarns being suitable when sheared, napped, brushed, or otherwise raised for achieving a plush surface effect in the knitted fabric, as herein described. The middle guide bar II is likewise threaded on every guide eye with a second set of yarns 12 delivered from another warp beam (also not shown), suitable for formation of a ground structure for the fabric, while the bottom (or back) guide bar I is threaded with a set of elastic yarns 14 from a third warp beam (also not shown).

Preferably, all of the ground and pile yarns 10 are multifilament synthetic yarns, e.g., polyester, while the elastic yarns 14, as is typical, are monofilament. According to the invention, the pile yarns 10 should be so-called microdenier yarns, i.e., wherein each individual filament in each yarn is of a denier of less than one denier per filament. The ground yarns 12 need not be microdenier yarns, but the denier per filament of each ground yarn 12 should not exceed about 1.5 denier per filament and the total collective denier of each ground yarn 12 should exceed at least one-half that of the total collective denier of each pile yarn 10 and, more preferably, should more closely approach, but without exceeding, the total denier of the pile yarns 10, e.g., the total denier of the ground yarns 12 should most preferably exceed about 75 percent of the total denier of the pile yarns 10. The elastic yarns 14, on the other hand, should preferably be of a denier substantially less than that of the ground yarns 12. By way of example, suitable results have been achieved in experimental fabrics wherein each pile yarn 10 comprises 50 filaments collectively totaling 45 denier, i.e., 0.9 denier per filament, while each ground yarn 12 comprises 30 filaments collectively totaling 40 denier, i.e., 1.33 denier per filament, and the elastic yarn 14 is a 27 denier monofilament such as LYCRA® brand elastic yarn 14.

Referring now to the accompanying drawing, one particular embodiment of the present warp knitted fabric of a three-bar construction knitted according to the present invention on a three-bar warp knitting machine, is illustrated. In the accompanying drawings, the stitch construction of the pile, ground, and elastic yarns 10,12,14, as carried out by the respective lateral traversing movements of the guide bars of the knitting machine according to one possible embodiment of the present fabric and method, are respectively illustrated individually in a traditional dot or point diagram format, wherein the individual points 15 represent the needles of the needle bar of the knitting machine in the formation of several successive fabrics courses C across several successive fabric wales W. According to this embodiment, the top (front) guide bar of the machine manipulates the pile yarns 10 to traverse laterally back and forth relative to the needles 15 of the needle bar of the machine to stitch the pile yarns 10 in a repeating 6-7,1-0 stitch pattern, as indicated at III of FIG. 1, as the pile yarns 10 are fed progressively from their respective warp beam. Simultaneously, the middle guide bar of the knitting machine manipulates the ground yarns 12 as they are fed from their respective warp beam to traverse relative to the needles 15 to stitch the ground yarns 12 in a repeating 1-2,1-0 stitch pattern, as indicated at II of FIG. 1. At the same time, the bottom (back) guide bar of the machine manipulates the elastic yarns 14 as they are fed from their respective warp beam to traverse relative to the needles 15 to stitch the elastic yarns 14 in a repeating 1-0,1-2 stitch pattern, as indicated at I of FIG. 1.

As will thus be understood, the ground yarns 12 are interknitted with one another in the described stitch construction with each ground yarn 12 being formed in needle loops $\mathbf{12}_n$ alternating course to course between a pair of adjacent vertical fabric wales W and in connecting underlaps $\mathbf{12}_u$ extending diagonally between the successive needle loops $\mathbf{12}_n$. The pile yarns 10 are interknitted with one another and with the ground yarns 12 with each pile yarn 10 being formed in needle loops $\mathbf{10}_n$ alternating from course to course between wales W spaced apart by five intervening wales, the needle loops $\mathbf{10}_n$ being interknitted in plated relationship with the needle loops $\mathbf{12}_n$ of the ground yarn 12 in the respective wales, and in elongated underlaps $\mathbf{10}_u$ extending diagonally between the successive needle loops $\mathbf{10}_n$ in a substantially coursewise direction. Each of the elastic yarns 14 is interknitted with the pile and ground yarns 10,12 in an opposing pattern to that of the ground yarns 12, forming needle loops $\mathbf{14}_n$ alternating from course to course between two adjacent wales W in plated relation to the needle loops $\mathbf{10}_n$,$\mathbf{12}_n$ of the pile and ground yarns 10,12.

As will thus be understood, the ground yarns 12 form a base or substrate to the fabric essentially between the pile and elastic yarns 10,14, to appear with the elastic yarns 14 essentially only at the technical face of the fabric, the ground yarns 12 providing structural integrity and dimensional stability to the fabric while the elastic yarns 14 permit a limited degree of walewise and coursewise stretchability to the fabric. The pile yarns 10 appear outwardly of the ground and elastic yarns 12,14 at the technical back of the fabric with the extended underlaps $\mathbf{10}_u$ of the pile yarns 10 forming pile-like loops which are sufficiently upstanding from the fabric ground structure to be shearable and brushable as indicated by the broken line depiction of the medial portions of the underlaps $\mathbf{10}_u$ to signify the portions removed by shearing.

Hence, after shearing and optional brushing of the pile yarn underlaps $\mathbf{10}_u$, each pile yarn is severed centrally along each underlap $\mathbf{10}_u$ into discrete pile yarn segments each comprising a needle loop $\mathbf{10}_n$ anchored in the ground structure of the fabric in plated relation with the needle loops $\mathbf{12}_n$,$\mathbf{14}_n$ of the of the ground and elastic yarns 12,14, from which pile segments extend in upstanding relation outwardly from the technical back of the fabric to collectively form a plush velvet-like fabric surface.

In contrast to the prior art, the present invention's unique combination of yarn types and yarn sizes as described above substantially resists any tendency of the discrete pile yarn segments and individual filaments thereof to be pulled from the ground structure during finishing or subsequent use of the fabric. In particular, by utilizing microdenier pile yarns and ground yarns which, although not microdenier, are nevertheless of a relatively low denier per filament, the yarns are relatively softer and more bendable than yarns of comparable total denier but fewer constituent filaments, whereby the plated needle loops of the ground and pile yarns are enabled to form into tighter needle loops which will tend to more securely anchor the pile yarn segments. The microdenier character of the pile yarns enhances this effect by providing a greater number of filaments in each pile yarn segment than with other yarns of comparable size, providing greater filament-to-filament cohesiveness and support so as to resist withdrawal from the ground structure, while at the same time the microdenier pile segments provide enhanced softness and plushness to the velvet surface effect. Since the ground yarns are of a total denier approaching that of the pile yarns, the size of the ground yarns further contributes to the secure anchoring of the pile yarn segments.

Of course, those persons skilled in the art will readily recognize and understand that many variations of the basic velvet fabric structure described above may be achieved by varying the specific yarns themselves, as well as their specific stitch and threading patterns. These and other variations of the specific embodiment described herein are considered to be within the conceptual scope and substance of the present invention.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention.

The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A textile fabric of a knitted construction characterized by a raised pile at one side of the fabric forming an upstanding plush surface which resists tendency of the pile to be pulled from the fabric, the fabric comprising a plurality of yarns interknitted with one another including yarns forming a ground structure for the fabric and yarns interknitted with the ground yarns and extending outwardly therefrom forming the raised pile, the ground yarns being multifilament synthetic yarns wherein each filament of the ground yarns is no greater than approximately 1.5 denier, the pile yarns being microdenier multifilament synthetic yarns wherein each filament of the pile yarns is less than about one denier, and wherein the total denier of each ground yarn is greater than about fifty percent (50%) of the total denier of each pile yarn.

2. A knitted textile fabric having a plush surface according to claim 1, wherein the total denier of each ground yarn is greater than about seventy-five percent (75%) of, but not essentially exceeding, the total denier of each pile yarn.

3. A knitted textile fabric having a plush surface according to claim 1, wherein the textile fabric is of a warp knitted construction having the pile and ground yarns interknitted with one another in stitches arranged in longitudinally extending fabric wales and transversely extending fabric courses.

4. A knitted textile fabric having a plush surface according to claim 3, wherein the pile yarns are warp knitted in coursewise spaced stitches with extended underlaps therebetween at the technical back of the fabric, the underlaps being severed and sheared uniformly to form the raised pile.

5. A knitted textile fabric having a plush surface according to claim 4, wherein the ground yarns are warp knitted in a stitch pattern which is generally dimensionally stable with stitches appearing predominantly at the technical face of the fabric.

6. A knitted textile fabric having a plush surface according to claim 5, wherein the stitches of the ground and pile yarns are knitted together in substantially every wale of substantially every course.

7. A knitted textile fabric having a plush surface according to claim 6, wherein the pile yarns are warp knitted in a 6-7,1-0 stitch pattern.

8. A knitted textile fabric having a plush surface according to claim 7, wherein the ground yarns are warp knitted in 1-2,1-0 stitch pattern.

9. A knitted textile fabric having a plush surface according to claim 4, wherein each pile yarn comprises a total of about 50 filaments of a total denier collectively of about 45.

10. A knitted textile fabric having a plush surface according to claim 9, wherein each ground yarn comprises a total of about 30 filaments of a total denier collectively of about 40.

11. A knitted textile fabric having a plush surface according to claim 1 and further comprising elastic yarns interknitted with the ground and pile yarns to provide the fabric with a degree of stretchability.

12. A knitted textile fabric having a plush surface according to claim 11, wherein each elastic yarn is a total denier substantially less than the ground yarns.

* * * * *